US008523581B2

(12) United States Patent
Martin et al.

(10) Patent No.: US 8,523,581 B2
(45) Date of Patent: Sep. 3, 2013

(54) HEADER CONNECTOR ASSEMBLY

(75) Inventors: Galen M. Martin, Camp Hill, PA (US); Joe Sakai, Greensboro, NC (US); Naomi Ishikawa, Kemersville, NC (US); Matthew Bryan Hitchcock, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/097,123

(22) Filed: Apr. 29, 2011

(65) Prior Publication Data

US 2012/0276761 A1 Nov. 1, 2012

(51) Int. Cl.
*H01R 12/00* (2006.01)

(52) U.S. Cl.
USPC ..... 439/83

(58) Field of Classification Search
USPC ..... 439/83, 79, 76.1, 247, 572, 80, 564
See application file for complete search history.

(56) References Cited

U.S. PATENT DOCUMENTS

| | | | | |
|---|---|---|---|---|
| 4,518,209 | A * | 5/1985 | Negley | 439/92 |
| 4,676,575 | A * | 6/1987 | Denlinger et al. | 439/271 |
| 5,236,375 | A | 8/1993 | Kachlic | |
| 5,266,054 | A | 11/1993 | Duncan et al. | |
| 6,343,953 | B2 | 2/2002 | Nakamura et al. | |
| 6,702,593 | B2 * | 3/2004 | Ogawa | 439/79 |
| 7,094,075 | B1 * | 8/2006 | Lim et al. | 439/79 |
| 7,883,373 | B2 | 2/2011 | Drew et al. | |

FOREIGN PATENT DOCUMENTS

| | | | |
|---|---|---|---|
| DE | 102007052608 | A1 | 5/2008 |
| EP | 1855361 | A2 | 11/2007 |
| JP | 10-172643 | | 6/1988 |
| JP | 2001-110506 | | 4/2001 |

OTHER PUBLICATIONS

International Search Report, International Application No. PCT/US2012/035320, International Filing Date Apr. 27, 2012.

* cited by examiner

*Primary Examiner* — Jean F Duverne

(57) ABSTRACT

A header connector assembly and a process of fabricating a header connector assembly is disclosed. The header connector assembly includes a header subassembly and a module. The header subassembly includes an outer housing and an inner housing, the inner housing having contacts and a circuit board, wherein the circuit board is attached to the header subassembly.

21 Claims, 6 Drawing Sheets

HEADER CONNECTOR ASSEMBLY

FIELD OF THE INVENTION

The present invention is directed to electrical assemblies, components for electrical assemblies, and processes of fabricating electrical assemblies and components for electrical assemblies. More specifically, the present invention relates to header connector assemblies, components for header connector assemblies, and processes for fabricating such components and assemblies.

BACKGROUND OF THE INVENTION

Headers for electrical connection are used for various applications. Headers can be used in electrical systems, for example, for vehicles, ships and boats, aerospace systems, electric tools, control systems, or other suitable electric products. Such headers can include a circuit board susceptible to damage upon being exposed to environmental conditions such as temperature changes and/or environmental substances such as moisture.

Headers can engage modules for enclosing circuit boards and for electrically connecting the circuit boards to other devices such as controllers, motors, sensors, other modules (for example, control modules), or combinations thereof. The circuit boards can additionally be secured to devices such as headers for interfacing with other electrical components such as plugs, transmitters, signal sources, or other devices for providing electrical signals to the module and/or devices in electrical connection with the module.

Known headers suffer from a drawback that they are susceptible to environmental conditions and/or substances affecting the circuit board within the header through unsealed interfaces between headers and modules. Additionally, fabrication of known headers suffers from a drawback that header materials have limited the temperature and methodology for securing the header to the circuit board.

Other known headers are damaged during transport. For example, in such known headers, pins or other fragile features can be broken during transport.

A header connector assembly and a process of fabricating a header connector assembly that do not suffer from one or more of the above drawbacks would be desirable in the art.

BRIEF DESCRIPTION OF THE INVENTION

In an exemplary embodiment, a header connector assembly having a header subassembly and a module includes an outer housing and an inner housing, the inner housing having contacts and a circuit board, wherein the circuit board is attached to the header subassembly by being one or more of wave soldered and surface mounted.

In another exemplary embodiment, a header connector assembly having a header subassembly and a module includes a header housing and one or more internal connectors. The one or more header internal connectors are positionable within the header housing.

In another exemplary embodiment, a process of fabricating a header connector assembly having a header subassembly and a module includes assembling a circuit board on an inner housing of the header connector assembly, installing the inner housing into an outer housing of the header connector assembly, the outer housing having mating interfaces to form the header subassembly, and assembling the header subassembly into the module.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided is an exemplary header connector assembly and an exemplary process of fabricating a header connector assembly. Embodiments of the present disclosure are capable of resisting environmental conditions and/or substances by being sealed, are capable of electrically communicating with other electrical components, are capable of interfacing with modules of various designs, are capable of being used with horizontally oriented modules, are capable of being fabricated by various previously unavailable methods, are protected from having components broken during transportation, and combinations thereof. For example, in some embodiments, by separating portions of a header, fabrication and/or transportation can be performed with less risk of damage. Likewise, in some embodiments, additional features such as shrouds protect mating terminals and/or pins by surrounding them.

Figure 1:
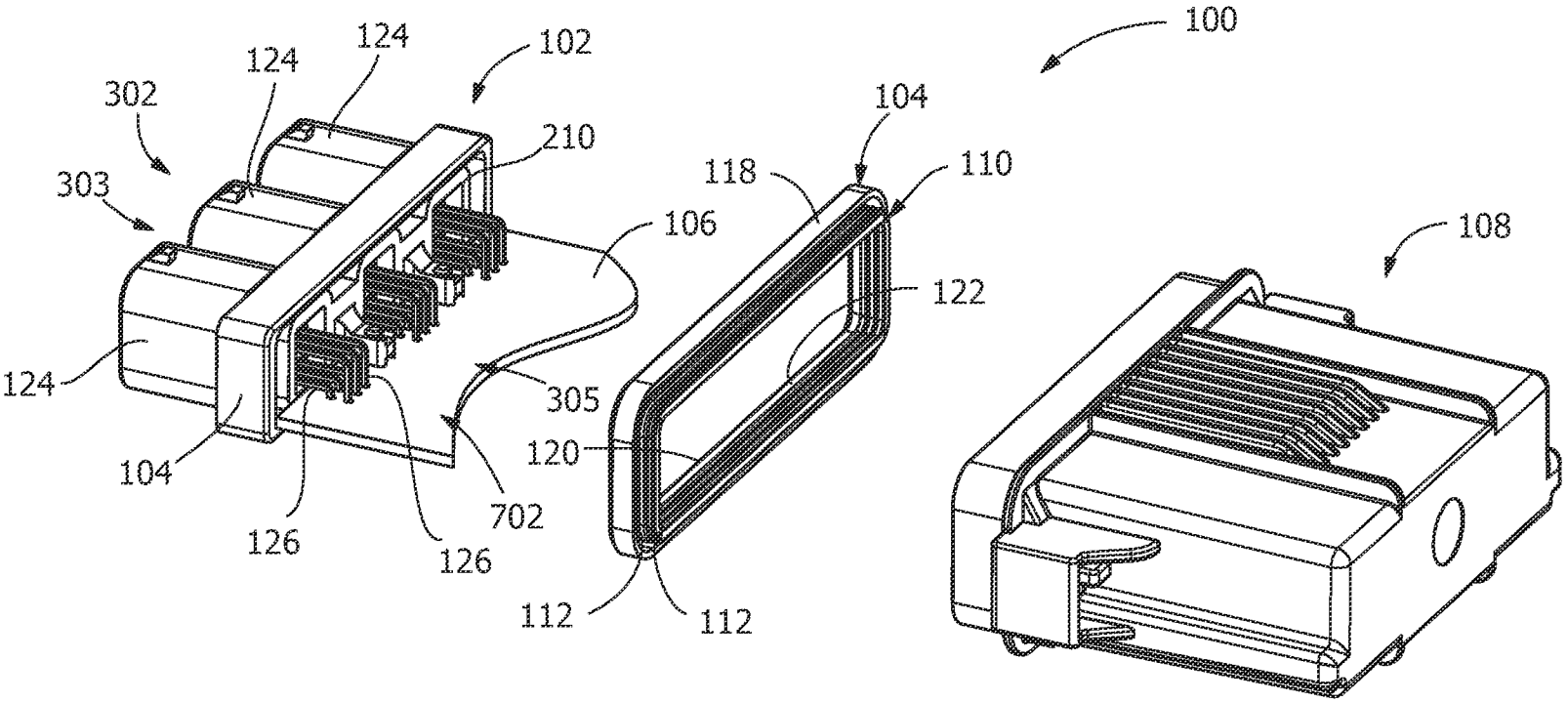
FIG. 1 shows a perspective view of an exemplary disassembled header connector assembly according to the disclosure.
Figure 2:
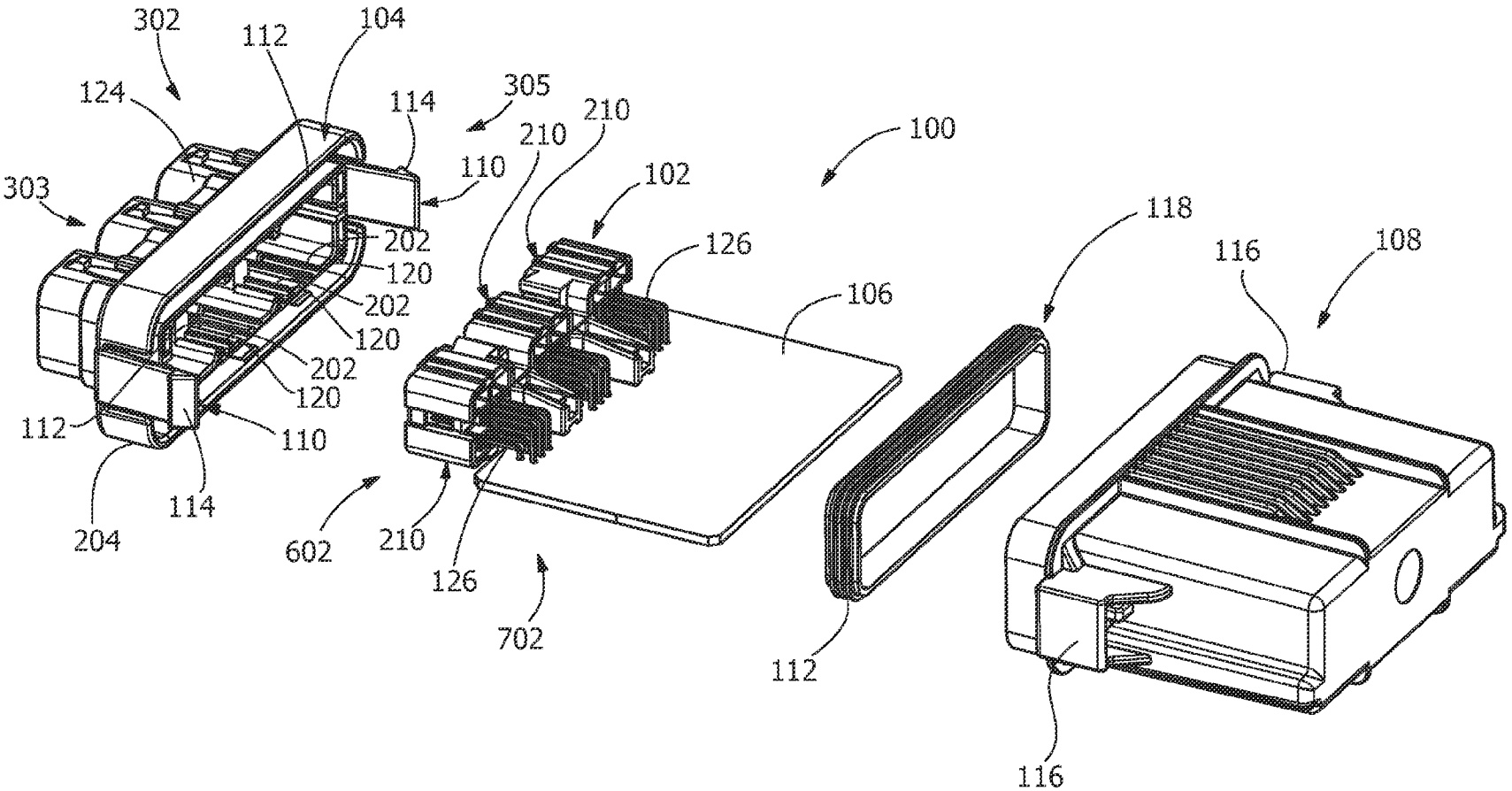
FIG. 2 shows a perspective view of an exemplary disassembled header connector assembly according to the disclosure.

Referring to FIGS. 1 and 2, a header connector assembly 100 includes a header subassembly 102, a seal 118, and a module 108. The header subassembly 102 includes an outer housing 302 and an inner subassembly 702. Upon positioning the header subassembly 102 and the seal 118 within the module 108, inner subassembly 702 is sealed from moisture or other environmental substances and/or conditions. The outer housing 302 remains exposed to the environment upon assembly. In one embodiment, the header subassembly 102 is mounted within the module 108 in a horizontal direction. As used herein, the term "horizontal," or grammatical variations thereof, refers to a direction or orientation parallel with the surface of a circuit board 106 such as a printed circuit board.

For example, a direction horizontal with the circuit board 106 is in a plane parallel to the surface of the circuit board 106. In one embodiment, the module 108 includes circuit board alignment features 107 (see FIGS. 8 and 9) arranged and disposed for horizontal insertion of the circuit board 107 (see FIGS. 8 and 9) into the module 108. In one embodiment, the module 108 is capable of being a part of an electrical system, for example, for vehicles, ships and boats, aerospace systems, electric tools, control systems, or other suitable electric products. In one embodiment, the module is a seat-weight sensor module. Input from seat-weight sensors are processed and sent to a main airbag control module (not shown) that determines whether or not an airbag (not shown) should be deployed and with what force it should be deployed.

The seal 118 includes an elastomeric material (for example, a silicon rubber) having module ribbed sections 112 for facilitating a seal when assembled. The elastomeric material is positioned within a shroud 104 of the header subassembly 102, as in the embodiment shown in FIG. 2, or surrounds the shroud 104 as in the embodiment shown in FIG. 1. The header connector assembly 100 includes module engagement features 110 which are any suitable features permitting a sealed or substantially sealed engagement between the header subassembly 102, the seal 118, and the module 108. Suitable features include, but are not limited to, one or more ribbed sections 112 (see FIG. 1) for facilitating an interference fit and/or one or more clipping mechanisms 114 (see FIG. 2) for facilitating a mechanical engagement. The engagement features 110 maintain the header connector assembly 100 in a sealed condition upon being assembled.

Figure 9:
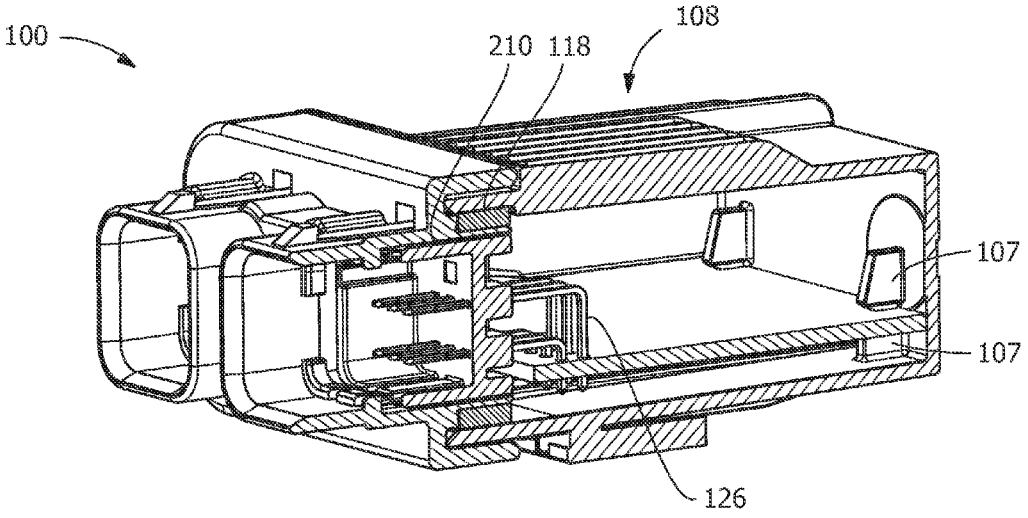
FIG. 9 shows a cutaway section view of an exemplary assembled header connector assembly according to the disclosure.

Referring to FIGS. 1 and 2, in one embodiment, the seal 118 is made of the elastomeric material. In this embodiment, the seal 118 is a substantially rectangular geometry corresponding to the size and geometry of the module 108 and/or the shroud 104 of the header subassembly 102. The ribbed sections 112 are capable of being positioned within the module 108 and, upon assembly, the seal 118 abuts the module 108 to form a seal. Referring to FIGS. 1 and 9, in a further embodiment, the abutting of the module 108 is on a predetermined amount of planes or surfaces (for example, at least three, at least six, at least nine, or at least twelve) and extends external to the header connector assembly 100. In one embodiment, the module 108 includes corresponding features (not shown) for engaging the header subassembly 102.

Referring to FIGS. 1 and 2, the seal 118 further includes a header engagement feature 120 capable of forming an interference fit with the header subassembly 102. The header engagement feature 120 is any suitable feature capable of engaging the header subassembly 102. Suitable features include, but are not limited to, one or more peripheral seals 122 (see FIG. 1), keying features, one or more clipping mechanisms, threaded or partially threaded portions, tapered sections, fasteners (for example, bolts, screws, adhesive, magnets, other mechanical fastening features, and combinations thereof), other suitable securing features, or combinations thereof.

To assemble the embodiment of the header connector assembly 100 shown in FIG. 1, the header subassembly 102 is positioned within the seal 118 so that a tight interference fit and/or mechanical engagement is formed between the seal 118 and the shroud 104 of the header subassembly 102. The header subassembly 102 and the seal 118 are then inserted into the module 108. In one embodiment, the seal 118 is positioned around the header subassembly 102 and inserted into the module 108 together. In another embodiment, the header subassembly 102 is inserted into the module 108 and then the seal 118 is around the header subassembly 102.

Figure 8:
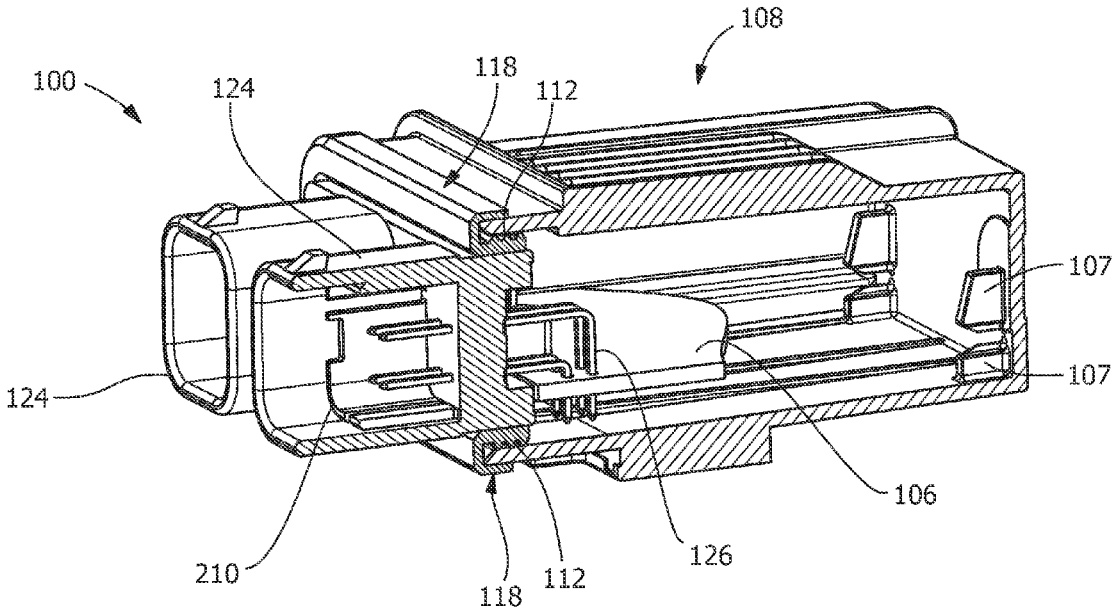
FIG. 8 shows a cutaway section view of an exemplary assembled header connector assembly according to the disclosure.

Upon being assembled, as shown in the cutaway section view of FIG. 8, the embodiment of the header connector assembly 100 shown in FIG. 1 is capable of providing electrical signals and/or power from the electrical device or mating connector (not shown) to the module 108 (see FIG. 1). As shown in FIG. 8, in one embodiment, the seal 118 is completely within the shroud 104 and encloses the internal connectors 210, thereby protecting the contacts 126 and/or the circuit board 106.

Referring to FIGS. 1 and 2, the header subassembly 102 includes the outer housing 302 and an inner subassembly 702. The outer housing 302 includes a mating end 303 and a mounting end 305. One or more enclosures or mating interfaces 124 extend from the mating end 303 for attachment and/or mating to one or more mating connectors (not shown) or other devices (not shown). The shroud 104 surrounds the outer housing 302 at the mounting end 305. The mating interfaces 124 are sized and shaped to enclose internal connectors 210 wherein each internal connector 210 supports one or more contacts 126 such as electrically conductive leads, pins, or other suitable conductive structures. The one or more contacts 126 are attached to the circuit board 106, for example, by wave soldering, press fitting, surface mounting, other suitable securing mechanisms, or combinations thereof.

Referring to FIG. 2, in one embodiment, the outer housing 302 includes the module engagement features 110. Upon assembly, the seal 118 abuts the module 108 and, in one embodiment, is completely enclosed by the shroud 104. For example, in this embodiment, the seal 118 is within the shroud 104. In one embodiment, the shroud 104 and/or the seal 118 further includes the header engagement features 120 capable of forming an interference fit with the header subassembly 102. The header engagement features 120 are any suitable features capable of engaging the header subassembly 102. Suitable features include, but are not limited to, keying features 202, one or more of the peripheral seals, one or more clipping mechanisms, threaded or partially threaded portions, tapered sections, fasteners (for example, bolts, screws, adhesive, magnets, other mechanical fastening features, and combinations thereof), other suitable securing features, or combinations thereof.

In one embodiment, the module 108 includes corresponding features such as mating features 116 for engaging the shroud 104, a header housing 204 having the shroud 104, and/or the seal 118. Such corresponding features are capable of being positioned on the inside of the module 108 and/or on the outside of the module 108.

Figure 3:
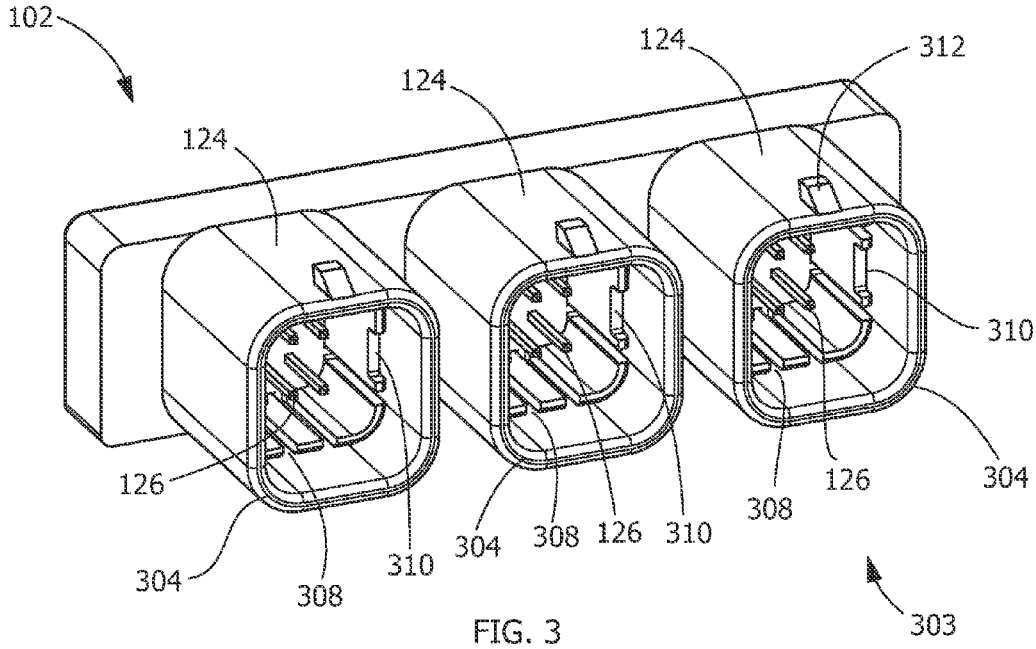
FIG. 3 shows an engagement end view of an exemplary header subassembly according to the disclosure.

FIG. 3 shows a view from the mating end 303 of an exemplary embodiment of the header subassembly 102. Consistent with the embodiment shown in FIG. 1, in this embodiment, the header subassembly 102 is a unitary structure secured to the circuit board 106 (see FIG. 1) and including one or more mating interfaces 124 configured to engage electrical devices (not shown) and/or mating connectors (not shown) such as harness connectors, plugs, transmitters, signal sources, or other components for providing electrical signals and/or power to the module 108 and/or components (not shown) in electrical connection with the module 108 (see FIG. 1). Although shown with three mating interfaces 124 in FIG. 3, other embodiments of the header subassembly 102 include one mating interface 124, two mating interfaces 124, or more than three mating interfaces 124. As shown in FIG. 3, in one embodiment, each of the mating interfaces 124 includes a cuboid perimeter 304 extending around the contacts 126 protruding from within the header subassembly 102. The header subassembly 102 further includes channels 308 or slots, one or more recesses 310, and one or more protrusions 312 for releasable securing of the header subassembly 102 to the mating connectors (not shown).

Figure 4:
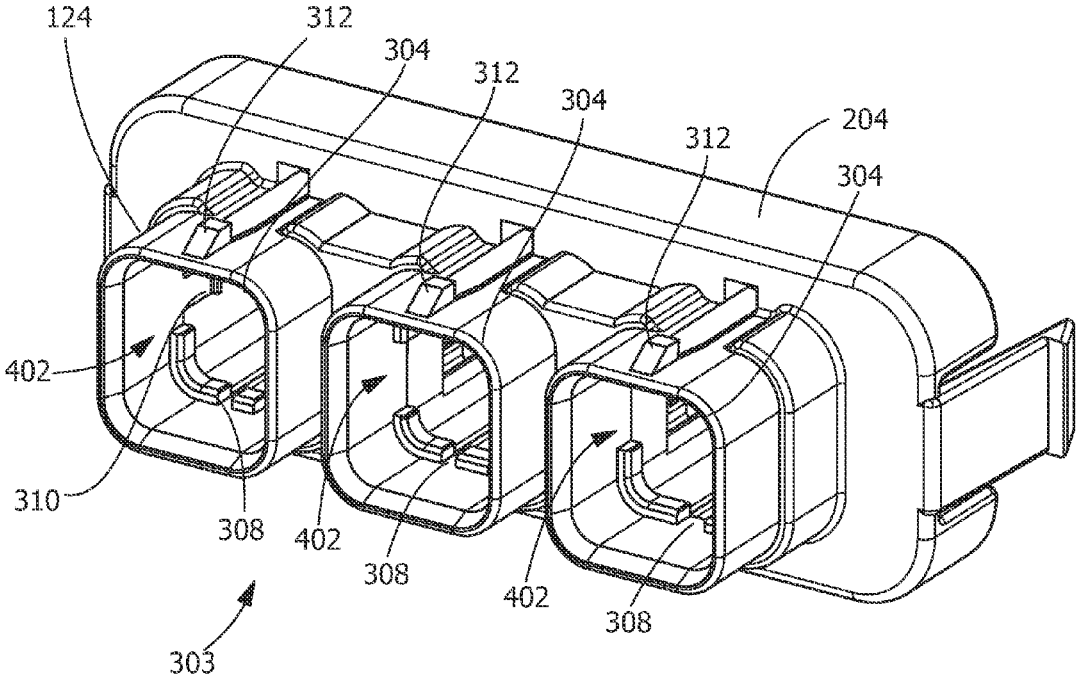
FIG. 4 shows an engagement end view of a header housing for an exemplary header subassembly according to the disclosure.

FIG. 4 shows a view from the mating end 303 of an exemplary embodiment of the header subassembly 102. In one embodiment, the header subassembly 102 is or includes a material capable of being damaged by wave soldering and/or surface mounting (for example, the seal 118 and/or the elastomeric material). As shown in FIG. 2, in one embodiment having such capabilities, the header subassembly 102 is a two-part structure including the header housing 204 and the internal connectors 210.

The header housing 204 includes the one or more mating interfaces 124 capable of engaging mating connectors (not shown) such as harness connectors, plugs, transmitters, signal sources, or other components for providing electrical signals to the module 108 and/or components (not shown) in electrical connection with the module 108. Although the embodiment shown in FIG. 2 includes three mating interfaces 124, in other embodiments, only one mating interface 124, only two mating interfaces 124, or more than three mating interfaces 124 are included in the header housing 204. As shown in FIG. 4, in one embodiment, each of the mating interfaces 124 includes the cuboid perimeter 304 extending around an open region 402 devoid of pins when unassembled. The mating interfaces 124 further include channels 308 or slots, one or more recesses 310, and a protrusion 312 for releasable securing of the mating interfaces 124 to the mating connectors (not shown).

Figure 5:
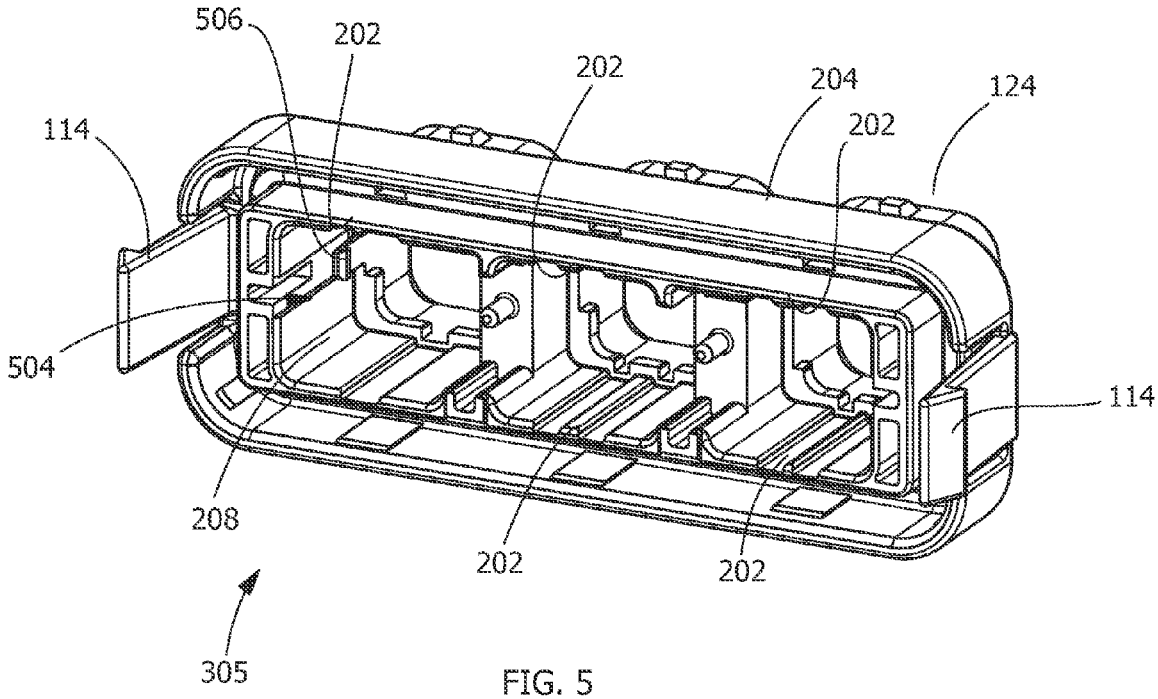
FIG. 5 shows a module end view of a header housing for an exemplary header subassembly according to the disclosure.

FIG. 5 shows a view from a mounting end 305 of the header housing 204. The mounting end 305 of the header housing 204 shows the keying features 202 for engaging the internal connectors 210 (see FIG. 2) and the module engagement features 110 including the clipping mechanisms 114 capable of engaging the mating features 116 (see FIG. 2) of the module 108 (see FIG. 2). In one embodiment, the clipping mechanisms 114 are capable of being positioned within the mating features 116 (see FIG. 2) of the module 108, thereby securing the shroud 104 (see FIG. 2) to the module 108 (see FIG. 2). In addition to the keying features 202 and a clipping member 506 for engagement, the header housing 204 further includes an interior chamber 208 configured to receive the internal connectors 210 (see FIG. 2) of the header subassembly 102. In one embodiment, the interior chamber 208 is a unitary chamber, such as, a substantially rectangular recess, for receiving a plurality of internal connectors 210 (see FIG. 2) of the header subassembly 102 (see FIG. 2). In another embodiment, the interior chamber 208 includes individual sub-chambers (not shown), such as cuboid recesses, corresponding to the number of the internal connectors 210 (see FIG. 2) in the header subassembly 102. The header housing 204 further includes other suitable features for releasably securing the internal connectors 210 (see FIG. 2) of the header subassembly 102 (see FIG. 2).

Figure 6:
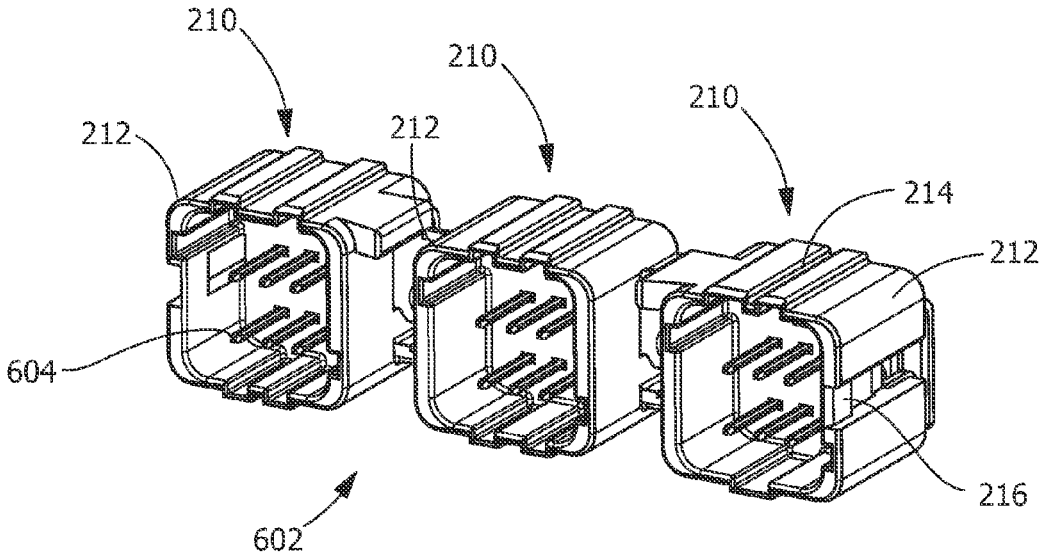
FIG. 6 shows a header housing end view of internal connectors of an exemplary header subassembly according to the disclosure.

FIG. 6 shows a view from a header housing end 602 of the internal connectors 210 of the inner housing consistent with the embodiment shown in FIG. 2. In this embodiment, the internal connectors 210 include geometric features such as curved corners 212 corresponding to the interior chamber(s) 208 (see FIG. 5), alignment channels 214 corresponding to the keying features 202 (see FIG. 5), securing mechanisms 216 for releasably (for example, manually or with a tool) or permanently engaging a feature in the header housing 204 (for example, a clipping member 506 as shown in FIG. 5), other suitable alignment and/or securing features, or combinations thereof.

Figure 7:
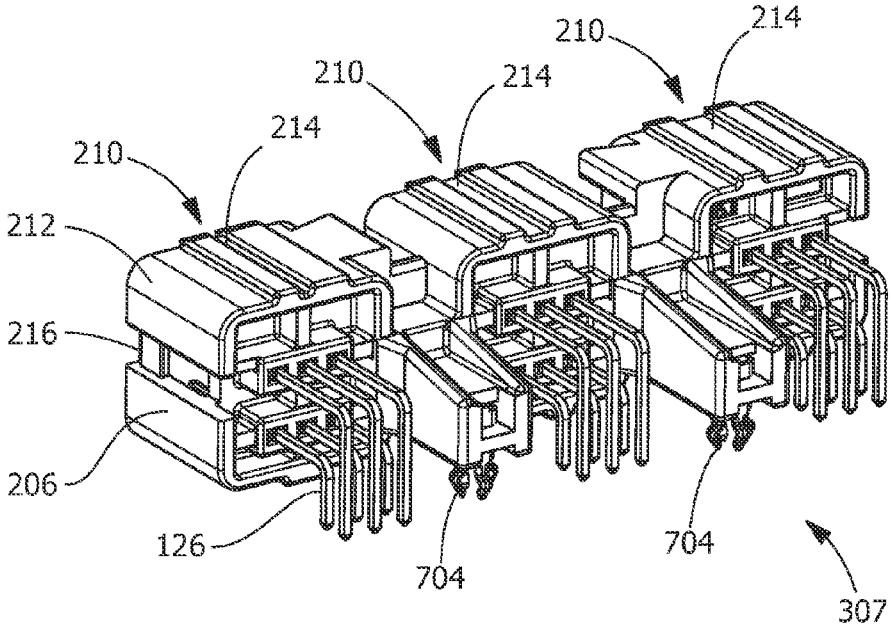
FIG. 7 shows a view of a module end view of internal connectors of an exemplary header subassembly according to the disclosure.

FIG. 7 shows a view of a module end 307 of an exemplary embodiment of the inner subassembly 702 consistent with the embodiment shown in FIG. 2. In this embodiment, the internal connectors 210 are secured to the circuit board 106 (see FIG. 2), for example, through a fastener 704 such as a screw, a detent, a bolt, or other securing mechanism. Contacts 126 extend from the header housing 204, through the internal connectors 210, and into the circuit board 106 (see FIG. 2). The contacts 126 extend through the internal connectors 210 into the header housing 204 when the header subassembly 102 (see FIG. 2) is assembled. In the embodiment with the contacts 126 secured by wave soldering and/or surface mounting, internal connectors 210 of the header subassembly 102 are devoid of material capable of being damaged by wave soldering and/or surface mounting. In a further embodiment, the header housing 204 (see FIG. 2) includes material capable of being damaged by wave soldering and/or surface mounting, for example, the seal 118. In this embodiment, the header housing 204 is assembled with internal connectors 210 of the header subassembly 102 after any wave soldering and/or surface mounting is completed.

Referring again to FIG. 2, in an exemplary process of fabricating the header connector assembly 100, the header subassembly 102 is positioned on the circuit board 106 and secured to the circuit board 106. The header subassembly 102 is secured to the circuit board 106 through any suitable securing method. Suitable securing methods include, but are not limited to, wave soldering, press fitting, surface mounting, or other suitable combinations thereof. The header subassembly 102 is then inserted through the shroud 104. The header subassembly 102 and the shroud 104 are then inserted in a horizontal direction into the module 108 where the circuit board 106 is secured and/or electrically connected and where the ribbed section 112 forms a tight interference fit with the module 108. In this embodiment, the shroud 104 is separate from the header subassembly 102. In another similar embodiment, the shroud 104 is positioned around the header subassembly 102 and inserted into the module 108.

Upon being assembled, as shown in the cutaway section view of FIG. 9, the header connector assembly 100 shown in FIG. 2 is capable of providing electrical signals and/or power from the electrical component (not shown) to the module 108 (see FIG. 2). In one embodiment the module is electrically or mechanically connected to other suitable components such as controllers, motors, sensors, other modules (for example, control modules), or combinations thereof. The seal 118 extends to the exterior of the connector assembly 100 and the internal connector (s) 210 are enclosed, thereby protecting the contacts 126 and/or the circuit board 106.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A header connector assembly, comprising:

a module; and a header subassembly arranged and disposed to be mounted with the module, the header subassembly comprising an outer housing and an inner housing;

wherein the outer housing having a mating end and a mounting end through which the inner housing is positioned in an interior chamber of the outer housing, the outer housing includes a shroud which surrounds the outer housing proximate the mounting end and a seal positioned entirely within the shroud, the outer housing having keying features; and wherein the inner housing includes contacts inserted therein and being secured to a circuit board, wherein the circuit board is attached to the header subassembly by being one or more of wave soldered and surface mounted, the inner housing having alignment channels which cooperate with the keying members to properly position the inner housing in the interior chamber of the outer housing;

wherein the module and the header subassembly are separate components of the header connector assembly.

2. The header connector assembly of claim 1, wherein the module includes circuit board alignment features, the circuit board alignment features arranged and disposed for horizontal insertion of the circuit board into the module.

3. The header connector assembly of claim 1, wherein the contacts extend from the circuit board through the inner housing and are capable of being mated at a mating end of the outer housing.

4. The header connector assembly of claim 1, wherein the seal abuts the header subassembly and the module, and the abutting of the module is on at least three planes or surfaces.

5. The header connector assembly of claim 4, wherein the seal includes a header engagement feature configured for engaging to form an interference fit with the header subassembly.

6. The header connector assembly of claim 1, wherein the circuit board is attached by wave soldering.

7. The header connector assembly of claim 1, wherein the header subassembly comprises one or more mating interfaces.

8. A header connector assembly having a header subassembly and a module, wherein the header subassembly comprises:

a header housing having an interior chamber with one or more engagement features positioned in the interior chamber; and one or more internal connectors having one or more securing mechanisms;

wherein the one or more internal connectors are secured within the header housing by the engagement of the one or more engagement features of the interior chamber of the header housing with the one or more securing mechanisms of the one or more internal connectors;

wherein the header subassembly further comprises a seal positioned entirely within a shroud of the header housing, the header subassembly is a unitary structure, or a combination thereof;

wherein the module and the header subassembly are separate components of the header connector assembly.

9. The header connector assembly of claim 8, wherein the seal abuts the header housing and the module, and the abutting of the module is on at least three planes or surfaces.

10. The header connector assembly of claim 9, wherein the seal includes a header engagement feature configured for engaging to form an interference fit with the header housing.

11. The header connector assembly of claim 8, wherein a circuit board is attached to the one or more internal connectors prior to the one or more internal connectors being installed into the header housing.

12. The header connector assembly of claim 11, wherein the circuit board is attached by wave soldering.

13. The header connector assembly of claim 8, wherein the one or more internal connectors include securing mechanisms configured for releasably or permanently engaging one or more clipping members of the header housing.

14. The header connector assembly of claim 8, wherein each of the one or more internal connectors includes a perimeter within a mating interface of the header housing, the perimeter extending around contacts protruding from within the internal connectors.

15. The header connector assembly of claim 8, wherein the one or more internal connectors include alignment channels for engaging corresponding keying features of the header housing.

16. The header connector assembly of claim 8, wherein the header subassembly further includes channels, slots, recesses, or a combination thereof for releasably securing to mating electrical devices or electrical connectors.

17. A process of fabricating a header connector assembly, the process comprising:

assembling a circuit board on an inner housing of a header subassembly;

assembling the inner housing in an outer housing of the subassembly, the assembling of the inner housing in the outer housing comprising:

aligning keying features of the outer housing with alignment members of the inner housing;

engaging securing members of the inner housing to engagement features of an interior chamber of the outer housing to secure the inner housing to the outer housing;

inserting the header subassembly into a module, the header subassembly including the inner housing and an outer housing, the outer housing having mating interfaces;

wherein the header subassembly further comprises a seal positioned entirely within a shroud of the outer housing, the header subassembly is a unitary structure, or a combination thereof.

18. The process of claim 17, wherein the assembling of the circuit board onto the inner housing is by wave soldering.

19. The process of claim 17, wherein the assembling of the circuit board onto the inner housing is by surface mounting.

20. The process of claim 17, wherein the assembling of the header subassembly into the module is in a horizontal direction.

21. A header connector assembly, comprising:

a module; and a header subassembly arranged and disposed to be mounted with the module, the header subassembly comprising an outer housing and an inner housing;

wherein the outer housing includes a shroud and a seal positioned entirely within the shroud; and wherein the inner housing includes contacts inserted therein and being secured to a circuit board, wherein the circuit board is attached to the header subassembly by being one or more of wave soldered and surface mounted;

wherein the module and the header subassembly are separate components of the header connector assembly;

wherein a module end of the inner housing, a mounting end of the outer housing and an end of the seal are approximately coplanar.

* * * * *